US009650840B2

(12) United States Patent
Cheng et al.

(10) Patent No.: US 9,650,840 B2
(45) Date of Patent: May 16, 2017

(54) METHOD AND APPARATUS FOR ERECTING A DRILLING RIG

(71) Applicant: National Oilwell Varco L.P., Houston, TX (US)

(72) Inventors: Rui Cheng, Shanghai (CN); Robert Cai, Shanghai (CN)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 14/697,509

(22) Filed: Apr. 27, 2015

(65) Prior Publication Data

US 2016/0312543 A1 Oct. 27, 2016

(51) Int. Cl.

| | |
|---|---|
| ***E21B 15/00*** | (2006.01) |
| ***E04H 12/34*** | (2006.01) |
| *E21B 7/02* | (2006.01) |
| *E04H 12/00* | (2006.01) |

(52) U.S. Cl.

CPC ..... *E21B 15/00* (2013.01); *E04H 12/345* (2013.01); *E04H 12/00* (2013.01); *E21B 7/02* (2013.01); *E21B 15/003* (2013.01)

(58) Field of Classification Search

CPC ..... E21B 15/003; E21B 15/00; E21B 7/02; E04H 12/345; E04H 12/00

USPC ..... 52/632, 651.05, 111, 114, 116, 117; 14/69.5–72.5

See application file for complete search history.

(56) References Cited

U.S. PATENT DOCUMENTS

| | | | | |
|---|---|---|---|---|
| 2,509,717 | A | | 5/1950 | Ausenda |
| 2,739,850 | A | | 3/1956 | Hollingsworth |
| 2,991,852 | A | | 7/1961 | Lee |
| 3,340,938 | A | | 9/1967 | Wilson |
| 3,789,565 | A | | 2/1974 | Lindholm |
| 3,807,109 | A | | 4/1974 | Jenkins et al. |
| 3,922,825 | A | | 12/1975 | Eddy et al. |
| 3,942,593 | A | | 3/1976 | Reeve, Jr. et al. |
| 4,135,340 | A | * | 1/1979 | Cox ..... E21B 15/00 173/151 |
| 4,269,395 | A | | 5/1981 | Newman et al. |
| 4,272,929 | A | | 6/1981 | Hanson |
| 4,290,495 | A | | 9/1981 | Elliston |

(Continued)

FOREIGN PATENT DOCUMENTS

| | | |
|---|---|---|
| EP | 0960986 | 11/2000 |
| EP | 1953334 | 11/2008 |

(Continued)

OTHER PUBLICATIONS

PCT/US2010/028786 Search Report dated Oct. 29, 2010, 3 pages.

(Continued)

*Primary Examiner* — Babajide Demuren

(74) *Attorney, Agent, or Firm* — Conley Rose, P.C.

(57) ABSTRACT

A method for erecting a drilling rig and an apparatus therefor having a mast, a base, a floor support, legs arranged between the base and the floor support, a primary lifting ram in engagement with the mast, and a floor support lifting ram, is disclosed. The method involves raising the mast with the primary lifting ram, raising the floor support with the floor support lifting ram to an intermediate height, engaging the primary lifting ram with the floor support and raising the floor support from the intermediate height to full working height with the mast lifting ram.

20 Claims, 6 Drawing Sheets

(56) References Cited

U.S. PATENT DOCUMENTS

| | | | | |
|---|---|---|---|---|
| 4,311,434 | A | 1/1982 | Abe | |
| 4,368,602 | A | 1/1983 | Manten | |
| 4,489,526 | A | 12/1984 | Cummins | |
| 4,569,168 | A | 2/1986 | McGovney et al. | |
| 4,604,961 | A | 8/1986 | Ortloff et al. | |
| 4,818,004 | A | 4/1989 | Oswalt et al. | |
| 4,837,992 | A | 6/1989 | Hashimoto | |
| 5,109,953 | A | 5/1992 | Mathis | |
| 5,247,776 | A | 9/1993 | Tamayo | |
| 5,407,302 | A | 4/1995 | Springett et al. | |
| 6,357,549 | B1 | 3/2002 | Brennan et al. | |
| 6,522,025 | B2 | 2/2003 | Willis et al. | |
| 6,523,319 | B2 | 2/2003 | Bockhorn et al. | |
| 6,614,125 | B2 | 9/2003 | Willis et al. | |
| 6,634,436 | B1 | 10/2003 | Desai | |
| 6,848,515 | B2 * | 2/2005 | Orr | E21B 15/00 173/1 |
| 6,868,646 | B1 | 3/2005 | Perina | |
| 7,112,010 | B1 | 9/2006 | Geiger | |
| 7,160,085 | B2 | 1/2007 | De Roest | |
| 7,207,777 | B2 | 4/2007 | Bervang | |
| 7,234,409 | B2 | 6/2007 | Hansen | |
| 7,308,953 | B2 * | 12/2007 | Barnes | E21B 7/02 175/122 |
| 7,413,393 | B1 * | 8/2008 | Barnes | B60P 3/40 280/404 |
| 7,456,515 | B2 | 11/2008 | Nielsen | |
| 7,739,843 | B2 | 6/2010 | Cortina-Cordero | |
| 7,770,343 | B2 | 8/2010 | Montaner Fraguet et al. | |
| 8,011,098 | B2 | 9/2011 | Vorhies et al. | |
| 8,118,552 | B2 | 2/2012 | Nies | |
| 8,201,787 | B2 | 6/2012 | Ingram et al. | |
| 8,496,423 | B2 | 7/2013 | Springett et al. | |
| 8,601,748 | B2 | 12/2013 | Delago et al. | |
| 8,727,690 | B2 | 5/2014 | Springett et al. | |
| 8,801,330 | B2 | 8/2014 | Springett et al. | |
| 2002/0171247 | A1 | 11/2002 | Willis et al. | |
| 2003/0172599 | A1 | 9/2003 | Frink | |
| 2004/0042876 | A1 | 3/2004 | Seegers et al. | |
| 2004/0169376 | A1 | 9/2004 | Ruer et al. | |
| 2004/0211598 | A1 * | 10/2004 | Palidis | E21B 15/00 175/162 |
| 2004/0217037 | A1 | 11/2004 | O'Kane et al. | |
| 2004/0262926 | A1 | 12/2004 | Hansen | |
| 2005/0129504 | A1 | 6/2005 | De Roest | |
| 2005/0158125 | A1 | 7/2005 | Thomas et al. | |
| 2005/0193645 | A1 * | 9/2005 | Barnes | E21B 7/02 52/120 |
| 2006/0120809 | A1 | 6/2006 | Ingram et al. | |
| 2006/0156681 | A1 | 7/2006 | Fernandez Gomez et al. | |
| 2007/0056801 | A1 | 3/2007 | Iverson | |
| 2007/0189895 | A1 | 8/2007 | Koostra et al. | |
| 2007/0243063 | A1 | 10/2007 | Schellstede | |
| 2007/0266538 | A1 | 11/2007 | Bervang | |
| 2007/0296220 | A1 | 12/2007 | Kristensen | |
| 2008/0164064 | A1 | 7/2008 | Belik et al. | |
| 2008/0216301 | A1 | 9/2008 | Hansen et al. | |
| 2009/0026304 | A1 | 1/2009 | Yu et al. | |
| 2009/0028647 | A1 | 1/2009 | Bingham et al. | |
| 2009/0087311 | A1 | 4/2009 | Wyborn | |
| 2009/0218138 | A1 * | 9/2009 | Donnally | E21B 15/00 175/57 |
| 2009/0218139 | A1 * | 9/2009 | Donnally | E21B 7/02 175/57 |
| 2009/0218144 | A1 * | 9/2009 | Donnally | E21B 15/00 175/162 |
| 2009/0283324 | A1 * | 11/2009 | Konduc | E21B 7/023 175/57 |
| 2009/0321135 | A1 * | 12/2009 | Vora | E21B 19/00 175/57 |
| 2010/0071301 | A1 | 3/2010 | De Roest | |
| 2010/0139181 | A1 | 6/2010 | Cortina-Cordero et al. | |
| 2010/0257797 | A1 | 10/2010 | Gomez et al. | |
| 2011/0072737 | A1 * | 3/2011 | Wasterval | E21B 7/021 52/115 |
| 2011/0088723 | A1 | 4/2011 | Jensen et al. | |
| 2012/0167485 | A1 * | 7/2012 | Trevithick | E21B 15/00 52/112 |

FOREIGN PATENT DOCUMENTS

| | | |
|---|---|---|
| EP | 1956234 | 7/2014 |
| FR | 2849877 | 12/2005 |
| GB | 2365905 | 5/2003 |
| JP | 2001254668 | 9/2001 |
| JP | 2004084322 | 3/2004 |
| JP | 2005002875 | 1/2005 |
| KR | 10-0798083 | 1/2008 |
| WO | 0134977 | 5/2001 |
| WO | 0248547 | 6/2002 |
| WO | 03093584 | 11/2003 |
| WO | 2008061797 | 5/2008 |
| WO | 2008084971 | 7/2008 |
| WO | 2008132226 | 11/2008 |
| WO | 2009001133 | 12/2008 |
| WO | 2009105836 | 9/2009 |
| WO | 2009106859 | 9/2009 |
| WO | 2009106860 | 9/2009 |
| WO | 2009106897 | 9/2009 |
| WO | 2009056969 | 10/2009 |
| WO | 2011031346 | 3/2011 |
| WO | 2011031347 | 3/2011 |
| WO | 2011031348 | 3/2011 |
| WO | 2011031577 | 6/2011 |
| WO | 2013032600 | 3/2013 |

OTHER PUBLICATIONS

International Search Report for PCT Application No. PCT/US2010/028791 dated Oct. 29, 2010, 3 pages.

PCT International Preliminary Report on Patentability for PCT Application No. PCT/US2010/028791 dated Mar. 13, 2012, 5 pages.

Examination Report for Canadian Patent Application No. 2,772,323 dated Aug. 20, 2013, 3 pages.

Examination Report for Canadian Patent Application No. 2,772,327 dated Aug. 27, 2013, 3 pages.

Examination Report for Canadian Patent Application No. 2,772,222 dated Aug. 19, 2013, 3 pages.

International Preliminary Report on Patentability for PCT Application No. PCT/US2010/028788 dated Mar. 13, 2012, 4 pages.

International Search Report for PCT Application No. PCT/US2010/028788 dated Mar. 17, 2011, 3 pages.

PCT/US2010/028786 Written Opinion dated Oct. 28, 2010, 3 pages.

PCT/US2010/028786 International Preliminary Report on Patentability dated Mar. 13, 2012, 4 pages.

PCT International Search Report for counterpart PCT Patent Application No. PCT/US2010/047150 dated Apr. 28, 3011, 2 pages.

First Office Action for Chinese Patent Application No. 201310718563.X dated Jun. 1, 2016, 5 pages.

* cited by examiner

Fig. 4
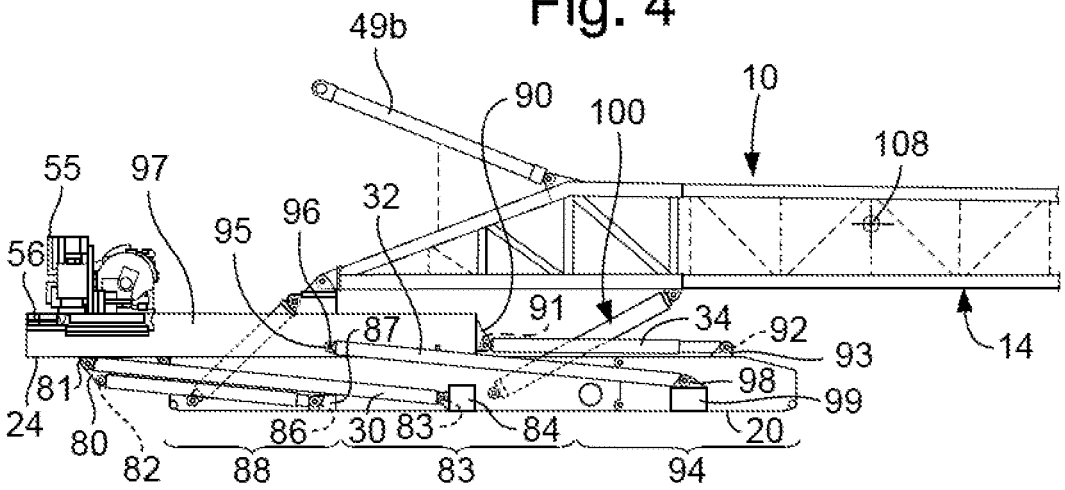
Fig. 5
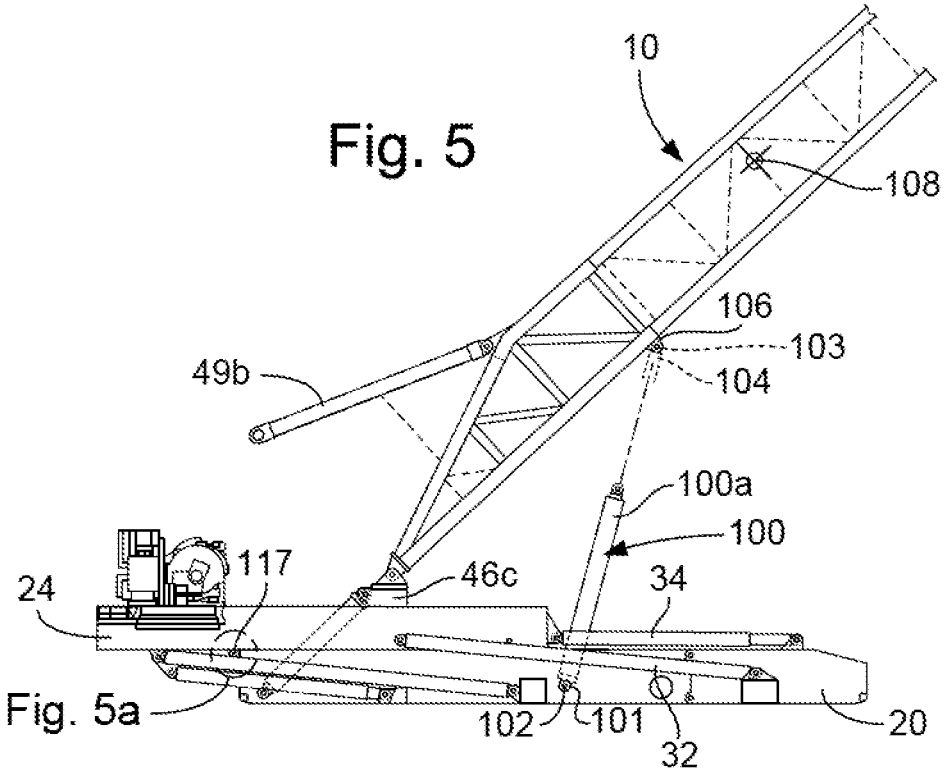
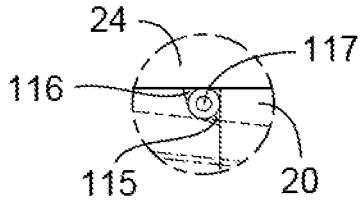
Fig. 5a

METHOD AND APPARATUS FOR ERECTING A DRILLING RIG

BACKGROUND

This disclosure relates to a method and apparatus for erecting a drilling rig and particularly, but not exclusively, to land rigs for drilling and servicing oil and gas wells.

A variety of drilling rigs may be used in drilling and various wellbore operations; for example, and not by way of limitation, U.S. Pat. Nos. 3,340,938; 3,807,109; 3,922,825; 3,942,593; 4,269,395; 4,290,495; 4,368,602; 4,489,526; 4,569,168; 4,837,992; 6,634,436; 6,523,319, the entire contents of which are hereby incorporated by reference herein for all purposes.

In many land drilling operations, land rigs may be delivered to a site, assembled and then disassembled. Land rig components may be easily transported and assembled. Costs associated with land rigs and associated equipment, can be calculated on a per hour or per day basis, and, therefore, efficient takedown, transport, and setup operations may be desirable. See example patent/applications U.S. Pat. No. 3,922,825; U.S. Pat. No. 3,942,593; U.S. Pat. No. 6,634,436; WO 2009/001133; WO 2009/106860; and WO 2009/106897, the entire contents of which are hereby incorporated by reference herein for all purposes.

SUMMARY

In accordance with the present disclosure, there is provided a method for erecting a drilling rig having a mast, a base, a floor support, legs arranged between the base and the floor support, a primary lifting ram in engagement with the mast and a floor support lifting ram, the method comprising raising the mast with the primary lifting ram, characterised in that the method further comprises raising the floor support with the floor support lifting ram to an intermediate height, engaging the primary lifting ram with the floor support and raising the floor support from the intermediate height to full working height with the mast lifting ram. Preferably, the intermediate height is between ground level and a working height. It should be noted that the mast is lifted with the floor support structure. The present disclosure is particularly useful for drilling rigs with very high rig floor substructure heights.

Advantageously, the primary lifting ram has a lower end and an upper end the method further comprising moving the upper end from engagement with the mast to engagement with the floor support. Preferably, the lower end of the primary lifting ram is rotatably connected to the base, the method further comprising rotating the primary lifting ram between engagement with the mast and engagement with the floor support.

Preferably, the base has a central portion, a front portion and a rear portion, the primary lifting ram is rotatably connected to the base in the central portion. Advantageously, the base has a central portion, a front portion and a rear portion, the floor lifting ram is rotatably connected to the base preferably, in the rear portion. Each of the front, central and rear portions are preferably each approximately a third of the length of the base.

Preferably, the floor support and the base are locked together, the method further comprising unlocking the floor support from the base after the mast is raised and before the floor support is raised. The floor support and base preferably comprise a lock to lock the base and the floor support together whilst the mast is being raised. The lock may comprise a pinned connection wherein each of the base and floor support may comprise lugs with holes therein for receiving a pin. Alternatively or additionally, the floor lifting ram may be provided with a hydraulic lock or a pinned connection to pin cylinders and pistons together to inhibit the floor support from moving relative to the base whilst the mast is being raised. Preferably, the primary lifting ram and the floor lifting ram comprise hydraulically actuated concentric telescoping cylinders, although they may be of the following: pneumatic; part pneumatic and part hydraulic; mechanical comprising, for example, a toothed cog or cogs running along a toothed track or a screw jack; electrical comprising, for example a linear actuator power.

Preferably, the method further comprises disengaging the floor support lifting ram from the floor support after the floor support has been engaged by the primary lifting ram and preferably, before the primary lifting ram raises the rig floor to the final working height.

Advantageously, the primary lifting ram extends whilst raising the mast, the primary lifting ram following an arc as it extends passing over vertical. Preferably, the primary lifting ram starts at an acute angle with the ground of preferably between ten and fifty degrees, most preferably, between twenty-five and thirty-five degrees and advantageously thirty degrees. Advantageously, the primary lifting ram finishes with an angle of preferably between fifty and ninety degrees from horizontal and most preferably, seventy degrees. Preferably, the floor support lifting ram starts at an angle of forty degrees and finishes at an angle of approximately sixty degrees.

Advantageously, the method further comprises installing at least one or more of the following before raising the rig floor support commences: a rig floor center section; a pipe rack; an iron roughneck; pipe handling equipment; a drawworks; and a dog house.

Preferably, the method further comprises installing at least one or more of the following before raising the mast commences: racking board; stabbing board; crown block; top drive track.

The present disclosure also provides an apparatus, such as a drilling rig under construction comprising a mast, a base, a floor support, legs arranged between the base and the floor support, a primary lifting ram connected to the base and a floor lifting ram connected to the base characterised in that the primary lifting ram is connected to a central portion of the base. The central portion of the base is preferably between the legs and advantageously, beneath the floor support when erected and preferably, beneath the floor support or substantially in line with or within one meter of a front of the floor of the support before erection of the mast commences.

Preferably, the apparatus further comprises an engaging member on the floor support for receiving an upper end of the primary lifting ram. The engaging member may be a pin welded to the floor support and advantageously, the engaging member may be fixed to any member fixed to the floor support, such as a mast shoe or a lug. Preferably, the connections between the lifting rams and the base, mast and floor support are rotatable connection and advantageously comprise a pin and most advantageously, lugs, preferably with holes therein.

Advantageously, the mast is pivotably connected to the floor support, most preferably on a mast shoe.

The present disclosure also provides a drilling rig under construction for use in the method of the disclosure.

BRIEF DESCRIPTION OF THE DRAWINGS

For a better understanding of the present disclosure, reference will now be made, by way of example, to the accompanying drawings, in which:

FIG. 4 is a side schematic view of part of the land rig shown in FIG. 1, at a first stage of erection;

FIG. 5 is a side schematic view of part of the land rig shown in FIG. 1, at a second stage of erection;

FIG. 5*a* is an enlarged part of FIG. 5;

DETAILED DESCRIPTION

Figure 1:
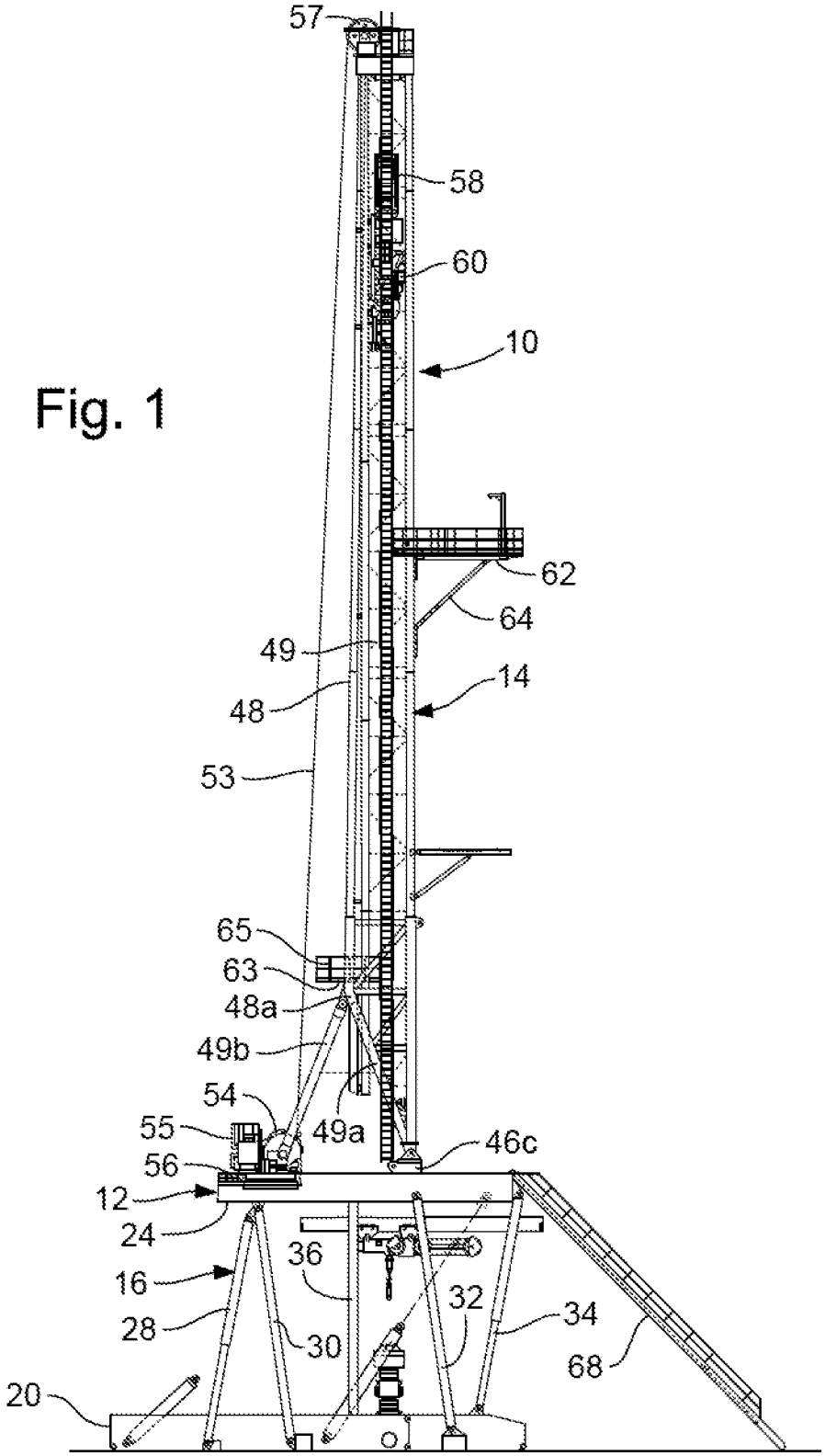
FIG. 1 is a side schematic view of a land rig in accordance with the present disclosure, the land rig shown erected, with parts removed to show otherwise hidden detail.
Figure 2:
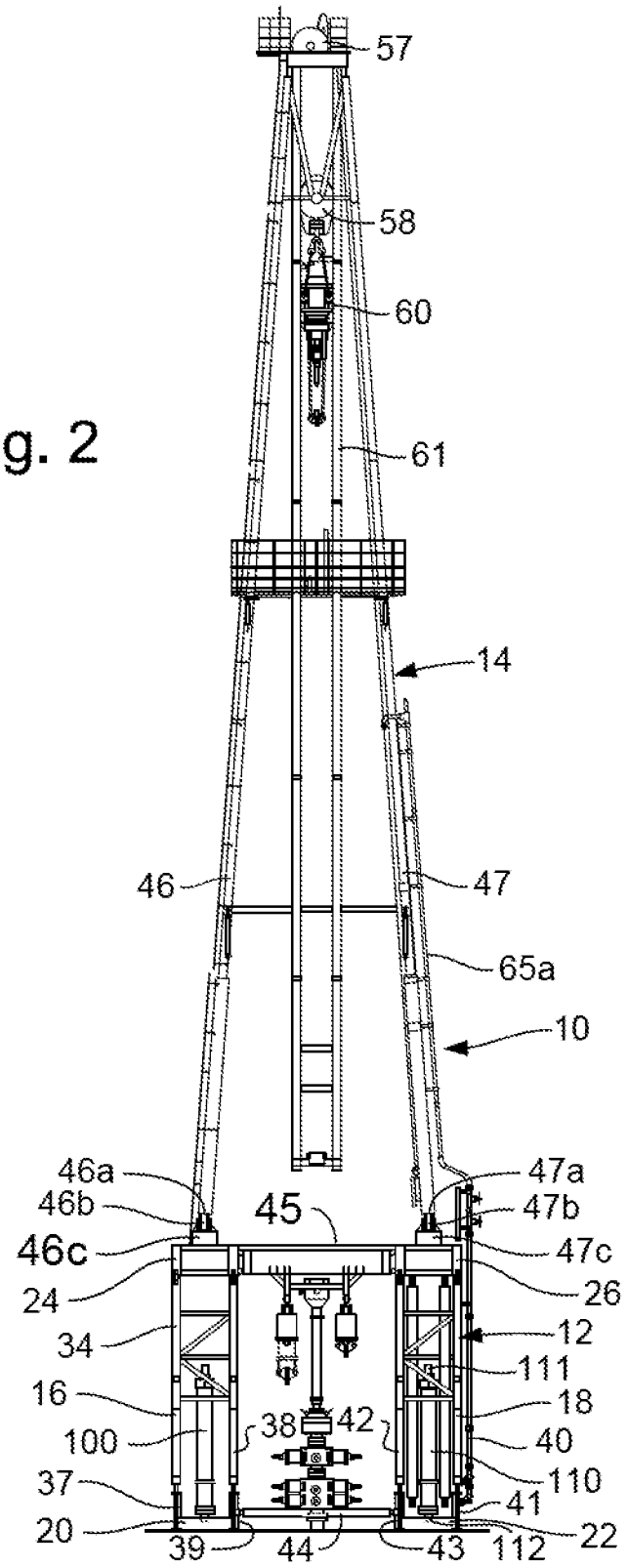
FIG. 2 is a front schematic view of the land rig shown in FIG. 1, with parts removed to show otherwise hidden detail.
Figure 3:
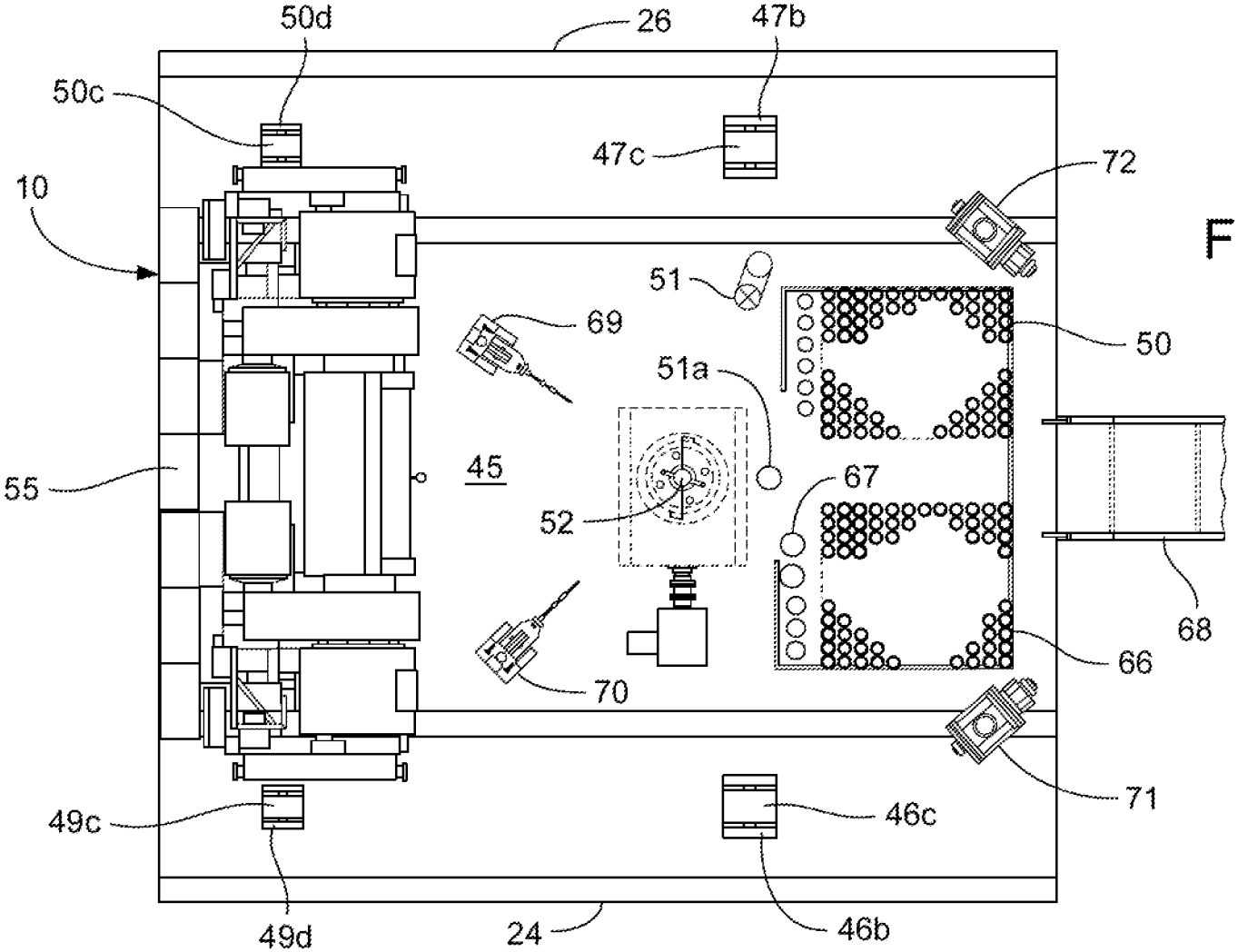
FIG. 3 is a top view of part of the land rig shown in FIG. 1, with the mast removed to show otherwise hidden detail.

FIGS. 1, 2 and 3 show a land rig 10 in accordance with the present disclosure which includes a substructure 12 and a mast 14.

The substructure comprises two side structures 16 and 18. Each side structure 16 and 18 has a base 20 and 22 and a floor support structure 24 and 26. Legs 30 and 32, a strut 36 and telescopic locking legs 28 and 34 are arranged between the base 20 and the floor support structure 24 on an outer side 37 of the side structure 16. A similar arrangement of legs, generally identified by reference numeral 38 is on an inner side 39 of the side structure 16. Similarly, an arrangement of legs 40 is arranged between base 22 and floor structure support 26 on the outer side 41 of the side structure 18 and a similar arrangement of legs, generally identified by reference numeral 42 is on an inner side 43 of the side structure 18.

The two side structures 16 and 18 are spaced by spacer pole(s) 44 connected between bases 20 and 22. A rig floor center section 45 sits between and is supported by the floor support structures 24 and 26.

The mast 14 comprises two front mast legs 46 and 47 and two rear mast uprights 48 and (not shown). Structural latticework 49 is arranged between the front legs 46 and 47 and the two rear mast uprights 48 and (not shown). Structural latticework may also be arranged between the two front mast legs 46 and 47 and between the two rear mast uprights 48 and (not shown), although structural latticework is arranged not to obstruct the V-door opening, so that tubulars and downhole tools can be moved from storage off-rig into pipe setback 50 and to mouse hole 51*a* and well center 52. A rat hole 51 is provided for a Kelly (not shown) for use in a rotary table (not shown). One side of the mast 14 may be substantially free of latticework to allow tubulars and other equipment move freely to and from alignment with well center 52 and on and off rig.

Pinned connections are provided at each foot of the front mast legs 46 and 47. Each foot is pinned to lugs 46*b* and 47*b* of mast shoes 46*c* and 47*c* supported by the side structures 16 and 18. Each shoulder 48*a* and (not shown) of the two rear mast uprights 48 and (not shown) has a lower strut 49*a* angled to return to foot 46*a* and 47*a*. A gin pole 48*b* and (not shown) is arranged between shoulder 48*a* and (not shown) and lug 49*d* and 50*d* of mast shoes 49*c* and 50*c* respectively.

A wireline 53 is arranged around a reel 54 of a drawworks 55 arranged on the rig floor 45 or on a skid 56 supported between the floor support structures 24 and 26. The wireline 53 passes over a crown sheave or block 57 to a travelling block 58 for raising and lowering a top drive 60 on a track 61 over well center 52. Racking board 62 and stabbing board 63 are hinged to the mast 14 and supported by racking board support poles 64 and stabbing board poles 65 respectively. A mud flow line 65*a* is arranged along front mast leg 47. Tubulars, such as drill pipe 66 and casing 67 is conveyed from an off-rig storage stock pile (not shown) to pipe setback 50 using a pipe conveyor 68 and pipe handling equipment 71 and 72. The pipe handling equipment 71 and 72 are arranged on front corners of the rig floor center section 45. Other tools, such as iron roughnecks 69 and 70 are arranged on the rig floor center section 45 about well center 52 and mouse-hole 51 for making up stands of drill pipe.

FIG. 4 shows a first stage of erection of the land rig 10 shown in FIGS. 1 to 3. The two side structures 16 and 18 have been off-loaded from one or more trucks. Each base 20 and 22 of each side structure 16 and 18 is arranged on the ground and placed parallel and in concert with one another at a predetermined spacing. Fixing the spacer pole 44 between the two bases 20 and 22 confirms the two side structures 16 and 18 are spaced correctly. Each floor support structure 24 and 26 is arranged on top of respective base 20 and 22. The floor support structures 24 have a width and an underneath provided with a lug 80 and (not shown) attached on each side. A top lug 81 of leg 30 is rotatably pinned to lug 80. Top lug 82 of the telescopic leg 28 is also rotatably pinned to lug 80. Bottom lug 83 of leg 30 is rotatably pinned to a foot lug 84 in a middle portion 85 of the base 20. A bottom lug 86 of telescopic locking leg 28 is rotatably pinned to a foot lug 87 in rear portion 88 of the base 20. The telescopic locking leg 28 is in a retracted position. The floor support structures 24 a front end lug 90 and (not shown) on each side of a front end. The front end lug 90 has a top lug 91 of telescopic locking leg 34 rotatably pinned thereto. Bottom lug 92 of telescopic locking leg 34 is rotatably pinned to a foot lug 93 on a front portion 94 of the base 20. A top lug 95 of leg 32 is rotatably pinned to a pin 96 in a side wall 97 floor support structures 24 and a bottom lug 98 of leg 32 is rotatably pinned to a foot lug 99 fixed to the front portion 94 of the base 20.

A primary lifting ram 100 is arranged between the two sides of side structure 16. The primary lifting ram 100 has an outer cylinder 100*a* with a lower ram lug 101 fixed thereto. The lower ram lug 101 is rotatably arranged on a lower ram axel 102 fixed between the two sides of side structure 16 in the central portion 83 of base 20. An upper ram lug 103 is fixed on an inner cylinder 104 of primary lifting ram 100. The primary lifting ram 100 may have one or more concentric intermediate cylinders 105 for telescoping a predetermined distance. The upper ram lug 103 is rotatably pinned to a mast lug 106. The mast lug 106 is advantageously located on the front leg 46, preferably at a point below and advantageously between the center of gravity 108 and the foot of the front mast leg 46. The center of gravity symbol identified by reference numeral 108 shows the position of the center of gravity of the mast 14 and anything else attached thereto at this stage of erection, such as the crown block 57, gin poles 49*b* and racking and stabbing boards 62 and 63.

A primary lifting ram 110 is located between sides of side structure 18 in a similar manner to the primary lifting ram 100 in side structure 16. A further mast lug (not shown) is fixed on the other front mast leg 47 and an upper ram lug 111 (see FIG. 3) is rotatably pinned thereto. A lower ram lug 112 is similarly rotatably pinned to a foot lug (not shown). Front mast legs 46 and 47 are rotatably pinned to lugs 46*b* and 47*b* respectively and the mast lies substantially horizontally. A top portion of the mast 14 rests on a dolly (not shown), part of a truck (not shown) or other suitable rest. The gin poles 49*b* and (not shown) are connected to a lower portion of the mast 14.

The primary lifting rams 100 and 110 may, for example be 18" (457 mm) two stage cylinder having outer cylinder 100*a* with a first stage bore size of 18" (457 mm), an intermediate cylinder 105 with a second stage bore size of 15" (381 mm). The primary lifting rams 100 and 110 may, for example have a full extend length 46' (14 m), working pressure 2600 psi (180 bar). The primary lifting rams 100 and 110 are preferably driven by hydraulic fluid flowing into the cylinders 124, 125 and 126 and advantageously by a common supply, such that the primary lifting rams operate in unison.

Referring to FIG. 5*a*, there is shown an enlarged view of part of the apparatus shown in FIG. 5, wherein a locking lug 115 is fixed to the underneath of the floor support structure 24. A further locking lug 116 is provided on a rear end of the base 20. A pin 117 is provided to lock the base 20 to the floor support structure 24.

Figure 6:
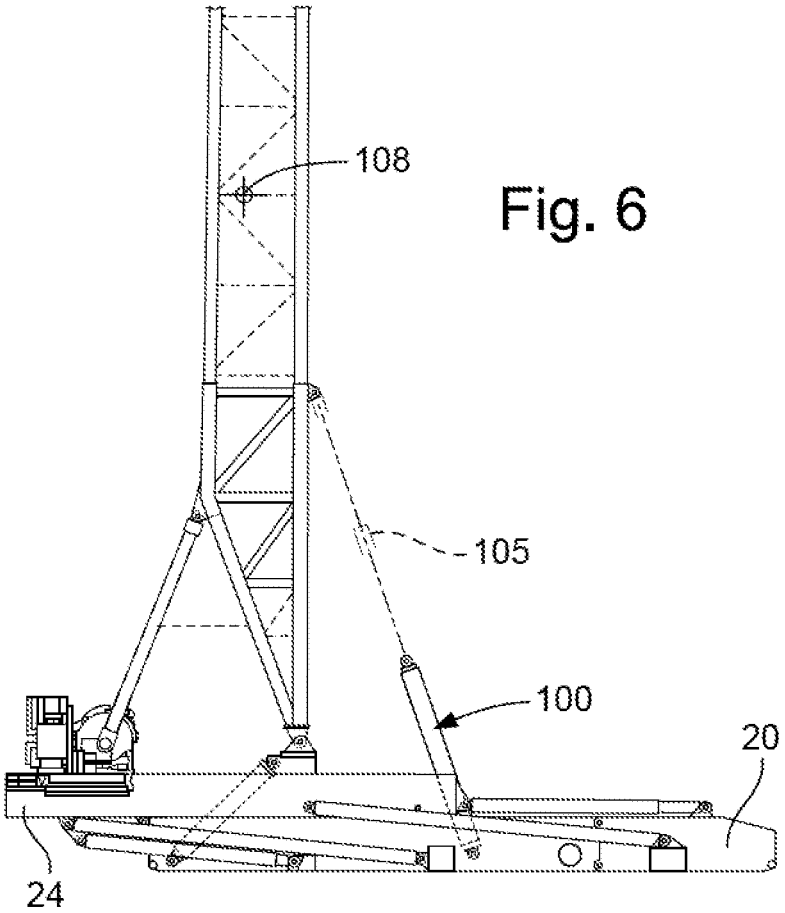
FIG. 6 is a side schematic view of part of the land rig shown in FIG. 1, at a third stage of erection.

The primary lifting rams 100 and 110 are activated simultaneously to extend from a fully refracted position. As the primary lifting rams 100 and 110 extend, the mast 14 is raised about pinned connection 46*c* and 47*c*. The primary lifting rams 100 and 110 sweep across an arc of preferably eighty degrees, starting from a two o'clock position (approximately thirty degrees from horizontal) anti-clockwise as viewed in FIGS. 4 to 6, through a twelve o'clock position, over-vertical to a twenty minutes past eleven o'clock position (approximately seventy degrees from horizontal) when the primary lifting rams 100 and 110 are fully extended, whereupon feet of gin poles 49*b* and (not shown) meet the mast shoes 49*c* and 50*c* and are pin connected together.

Figure 7:
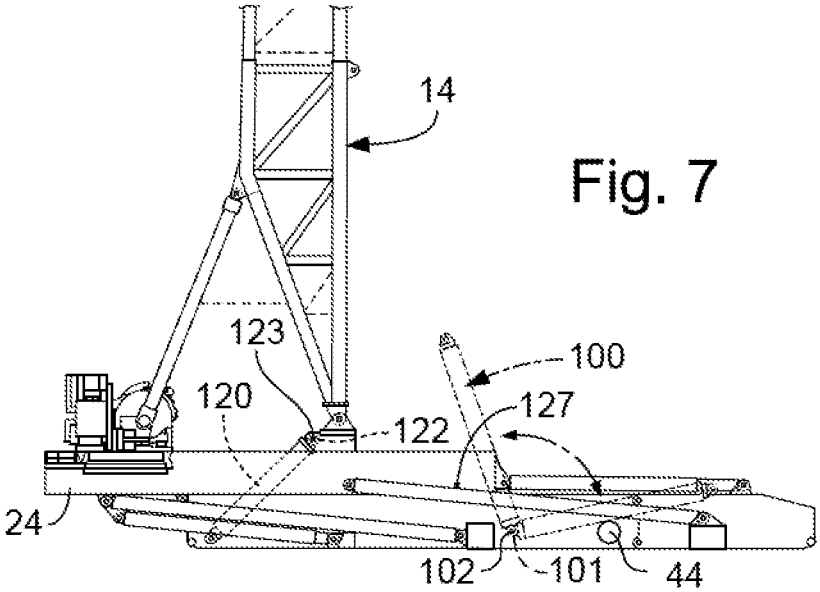
FIG. 7 is a side schematic view of part of the land rig shown in FIG. 1, at a fourth stage of erection.

Upper ends of the primary lifting rams 100 and 110 are disconnected from the mast lugs 106 and (not shown), retracted and rotated about pin connection 101,102 to lie down on the base 20, as shown in FIG. 7.

Pin 117 of the locking lug 115 is removed to unlock the base 20 from the floor support structure 24.

Each floor lifting ram 120 and (not shown) is arranged within each side structure 16 and 18. Each floor lifting ram 120 and (not shown) has a lower cylinder 124 of small diameter having a lower end provided with a lower lug 121 rotatably pinned to a side of the rear portion 88 of the base 20. Each floor lifting ram 120 and (not shown) also has an intermediate cylinder 125 and an upper cylinder 126 of large diameter. The upper cylinder has an upper end provided with an upper lug 122, which is rotatably pinned to a mast shoe lug 123 fixed to or formed integrally with the mast shoe 46*c*.

The floor lifting rams 120 and (not shown) may, for example be 18" (457 mm) two stage cylinder having outer cylinder 100*a* with a first stage bore size of 18" (457 mm), an intermediate cylinder 105 with a second stage bore size of 15" (381 mm). The lifting rams 100 and 110 may, for example have a full extend length of 28' 6" (8.7 m), working pressure 2600 psi (180 bar). The floor lifting rams 120 and (not shown) are preferably driven by hydraulic fluid flowing into the cylinders 124, 125 and 126 and advantageously by a common hydraulic supply, such that the lifting rams operate in unison.

The floor lifting rams 120 and (not shown) are activated simultaneously to raise the floor support structures 24 and 26 and everything supported thereby or thereon to an intermediate height, such as 5 m. At this stage, any or all of the following may be on or supported by the floor support structures 24 and 26: drawworks 55, pipe setback 50, iron roughnecks 69, 70, top drive 60, top drive tracks 61, center floor section 45, dog house (not shown), rotary table (not shown) etc.

Figure 8:
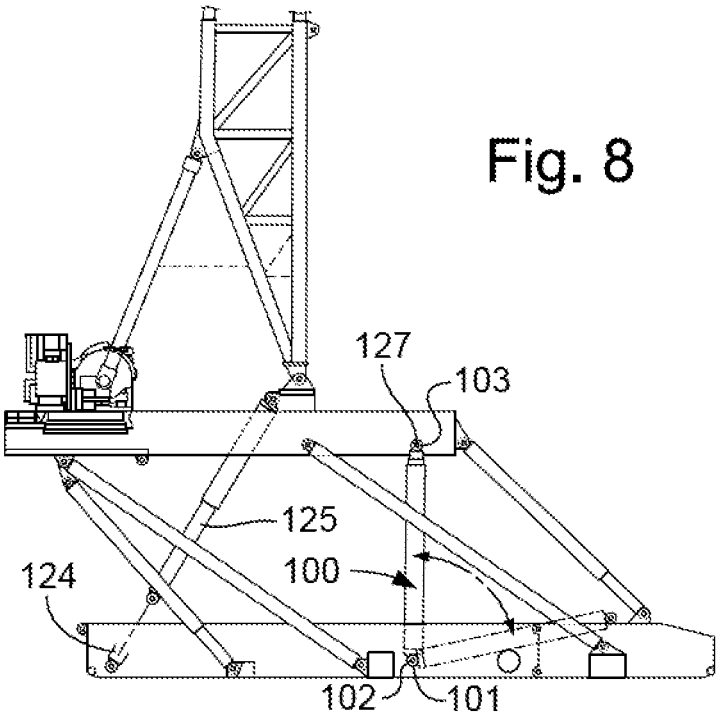
FIG. 8 is a side schematic view of part of the land rig shown in FIG. 1, at a fifth stage of erection.
Figure 9:
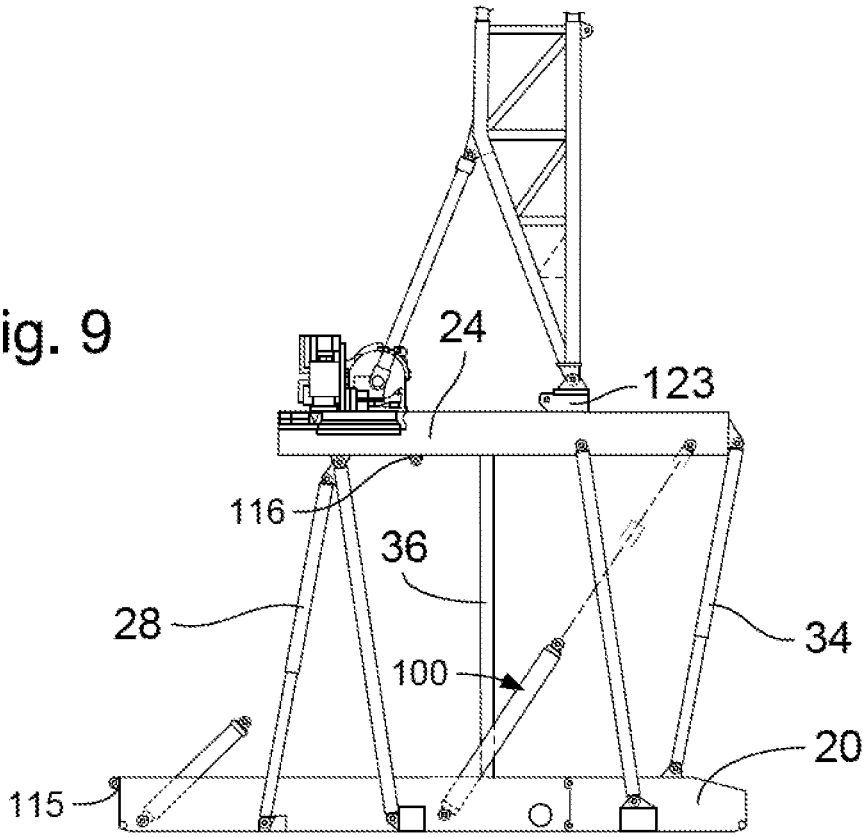
FIG. 9 is a side schematic view of part of the land rig shown in FIG. 1, at a sixth stage of erection.

Referring to FIG. 8, each of primary lifting rams 110 and 120 is swung about pinned connection 101, 102. The upper lug 103 is connected to a pin connection 127 in a side wall of the floor support structure 24 and similarly an upper lug of primary lifting ram 120 is connected to a pin connection in a side wall of the floor support structure 26.

The floor lifting rams 120 and (not shown) are disconnected from the floor support structures 24 and 26 by removing upper lug 122 from mast shoe lug 123.

The primary lifting rams 100 and 110 are activated simultaneously to raise the floor support structures 24 and 26 and everything supported thereby or thereon to working height, for example 10 m. Telescopic legs 28 and 34 are locked in their extended position by pins located through holes (not shown). The primary lifting rams 100 and 110 are then disconnected from the floor support structures 24 and 26. The strut 36 is added and fixed between the central portion 83 of the base 20 and the floor support structure 24. Similarly, a further strut (not shown) is added between base 22 and floor support structure 26. All of the primary and floor lifting rams 100, 110, 120 and (not shown) can now to laid down on the bases 20 and 22 or removed therefrom.

The mast 14 may be any suitable known type, such as a single-piece, multi-piece, and/or telescoping type.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, various combinations of the features provided herein may be provided.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A method for erecting a drilling rig comprising:

providing a mast, a base, a floor support, legs arranged between the base and the floor support, a primary lifting ram, and a floor support lifting ram;

raising the mast with said primary lifting ram, said primary lifting ram having a lower end positioned on the base between the legs and an upper end in engagement with said mast disengaging the primary lifting ram from the mast;

simultaneously raising said floor support and said mast disposed on said floor support with said floor support lifting ram to an intermediate height;

engaging said primary lifting ram with said floor support; and simultaneously raising said floor support and said mast disposed on said floor support from said intermediate height to full working height with said primary lifting ram.

2. The method of claim 1 further comprising moving said upper end from engagement with said mast to engagement with said floor support.

3. The method of claim 2, wherein said lower end of said primary lifting ram is rotatably connected to said base, the method further comprising rotating said primary lifting ram between engagement with said mast and engagement with said floor support.

4. The method of claim 3, wherein said base has a central portion, a front portion and a rear portion, said primary lifting ram being rotatably connected to said base in said central portion.

5. The method of claim 3, wherein said base has a central portion, a front portion, and a rear portion, said floor lifting ram being rotatably connected to said base, in said rear portion.

6. The method of claim 1, wherein said floor support and said base are locked together, the method further comprising unlocking said floor support from said base after said mast is raised and before said floor support is raised.

7. The method of claim 1, further comprising disengaging said floor support lifting ram from said floor support after said floor support has been engaged by said primary lifting ram.

8. The method of claim 1, wherein said primary lifting ram extends whilst raising the mast, the primary lifting ram following an arc as it extends.

9. The method of claim 1, further comprising installing at least one or more of the following before the raising said floor support commences: a rig floor center section; a pipe setback, an iron roughneck; pipe handling equipment; a drawworks; and a dog house.

10. The method of claim 1, further comprising installing at least one or more of the following before the raising the mast commences: racking board; stabbing board; crown block: top drive track.

11. An apparatus, comprising:

a mast;

a base;

a floor support;

legs arranged between the base and the floor support;

a primary lifting ram having a lower end and an upper end opposite the lower end, wherein the lower end is connected to a central portion of the base between the legs;

a floor lifting ram having a lower end connected to the base;

wherein the primary lifting ram has a first position with the upper end of the primary lifting ram directly connected to the mast for raising the mast and a second position with the upper end of the primary lifting ram directly connected to the floor support for raising the floor support.

12. The apparatus of claim 11, further comprising an engaging member on said floor support for receiving an upper end of said primary lifting ram.

13. The method of claim 1, wherein the engaging the primary lifting ram with the floor support further comprises attaching the upper end of the primary lifting ram to the floor support.

14. The method of claim 1, further comprising after the raising the mast, disengaging the primary lifting ram from the mast.

15. The apparatus of claim 11, wherein the legs comprise a pair of front legs and a pair of rear legs, with the primary lifting ram rotatably connected to the base between the pair of front legs and the pair of rear legs.

16. The apparatus of claim 11, wherein the base comprises a pair of side structures.

17. The apparatus of claim 11, wherein the primary lifting ram comprises an outer cylinder, an inner cylinder, a lower ram lug fixed to the outer cylinder, and an upper ram lug fixed to the inner cylinder, the lower ram lug rotatably connectable to the base and the upper ram lug rotatably connectable to the mast.

18. The apparatus of claim 11, further comprising an axle connected to the base, the primary lifting ram connected to the axle.

19. The apparatus of claim 11, wherein the floor lifting ram comprises a lower cylinder, an intermediate cylinder, an upper cylinder, a lower lug fixed to the lower cylinder, and an upper lug fixed to the upper cylinder, the lower lug rotatably connectable to the base, the upper lug rotatably connectable to the floor support.

20. The apparatus of claim 11, further comprising a mast shoe lug positioned on the floor support, the mast and the floor lifting ram rotatably connected to the mast shoe lug.

* * * * *